United States Patent [19]

Zils et al.

[11] Patent Number: 4,686,815

[45] Date of Patent: Aug. 18, 1987

[54] METHOD AND APPARATUS FOR LOADING ARTICLES

[75] Inventors: James A. Zils, Parma; Radoslav Markovic, Maple Heights, both of Ohio

[73] Assignee: RB & W Corporation, Mentor, Ohio

[21] Appl. No.: 870,082

[22] Filed: Jun. 3, 1986

[51] Int. Cl.[4] ..... B65B 9/10; B65B 5/10; B65B 1/22

[52] U.S. Cl. ..... 53/469; 53/437; 53/475; 53/244; 53/567; 53/525

[58] Field of Search ..... 53/437, 525, 469, 459, 53/475, 236, 244, 567, 576

[56] References Cited

U.S. PATENT DOCUMENTS

| | | | |
|---|---|---|---|
| 2,387,672 | 10/1945 | Mayberry | 53/525 X |
| 2,557,181 | 6/1951 | Flack | 53/525 |
| 2,935,830 | 5/1960 | Collins et al. | 53/525 X |
| 2,958,169 | 11/1960 | Flax | 53/469 |
| 2,973,572 | 3/1961 | Oakley | 53/525 X |
| 3,031,060 | 4/1962 | Philippovic et al. | |
| 3,125,208 | 3/1964 | Secunda | |
| 3,258,106 | 6/1966 | Booth | |
| 3,430,808 | 3/1969 | Matthews | |
| 3,940,908 | 3/1976 | Dazen et al. | 53/525 X |
| 4,312,438 | 1/1982 | Vatsvog | |

*Primary Examiner*—Horace M. Culver

*Attorney, Agent, or Firm*—Tarolli, Sundheim & Covell

[57] ABSTRACT

An improved method and apparatus is provided to load articles, such as nuts, into a tube. The nuts are fed into the tube from a bowl of vibratory feeder. In order to maintain the mass being vibrated constant during the feeding of the nuts into the tube, the tube and the bowl are vibrated together. Since the tube and the bowl are vibrated together, the nuts are vibrated when they are in the tube to move the nuts along the tube and to maintain the number of nuts being vibrated constant as the tube is filled with nuts. The tube is advantageously coiled and supported on the bowl.

19 Claims, 2 Drawing Figures

METHOD AND APPARATUS FOR LOADING ARTICLES

BACKGROUND OF THE INVENTION

The present invention relates to a method and apparatus for loading articles into a tube.

Pierce nuts have previously been mounted in sheet material by installation tools or assemblies, such as the installation tools shown in U.S. Pat. Nos. 4,153,989 and 3,098,576. The installation tools are mounted on the platens of punch presses. The installation tools have been supplied with nuts through flexible plastic tubes or hoses. It has been suggested that the tubes could be supplied with nuts from a rotary hopper in the manner disclosed in U.S. Pat. No. 3,430,808.

Articles have previously been fed from vibratory feeders having a construction similar to that disclosed in U.S. Pat. Nos. 3,031,060; 3,125,208 and 3,258,106. The vibratory feeders disclosed in these patents all discharge articles from a vibrating feed bowl to a location at which the articles are not vibrated. Therefore, the number of articles and the mass being vibrated is reduced during operation of the vibratory feeders. Since the mass which is being vibrated is reduced as the feeders are operated, it is very difficult or impossible to maintain an optimum amplitude and frequency of vibration during the operation of these vibratory feeders. Thus, as articles are fed from these vibratory feeders, the mass being vibrated decreases and the amplitude of feed bowl movement increases.

It has also been suggested that articles could be fed from a stationary container to a hollow tube by rotating a ring in the stationary container in the manner disclosed in U.S. Pat. No. 4,312,438. As the articles are fed into the hollow tube, both the container and the tube remain stationary.

SUMMARY OF THE INVENTION

The present invention provides a new and improved method and apparatus for loading articles into a tube. The apparatus includes a feed bowl which holds a plurality of articles. The tube is connected with the feed bowl for movement therewith. A motor vibrates the feed bowl, tube, and articles.

Vibration of the articles causes the articles to move from the feed bowl into the tube and to move along the tube. Since the articles in both the feed bowl and the tube are vibrated, the total number of articles and the mass being vibrated remains constant as the articles are fed from the feed bowl into the tube. It is preferred to support the tube in a coil adjacent to the upper portion of the feed bowl.

Accordingly, it is the object of this invention to provide a new and improved method and apparatus for feeding articles into a tube by vibrating the articles before and after they are fed into the tube to maintain the mass of articles being vibrated constant during the feeding of articles into the tube.

BRIEF DESCRIPTION OF THE DRAWINGS

The foregoing and other objects and features of the present invention will become more apparent upon a consideration of the following description taken in connection with the accompanying drawings wherein.

DESCRIPTION OF ONE SPECIFIC PREFERRED EMBODIMENT OF THE INVENTION

Figure 1:
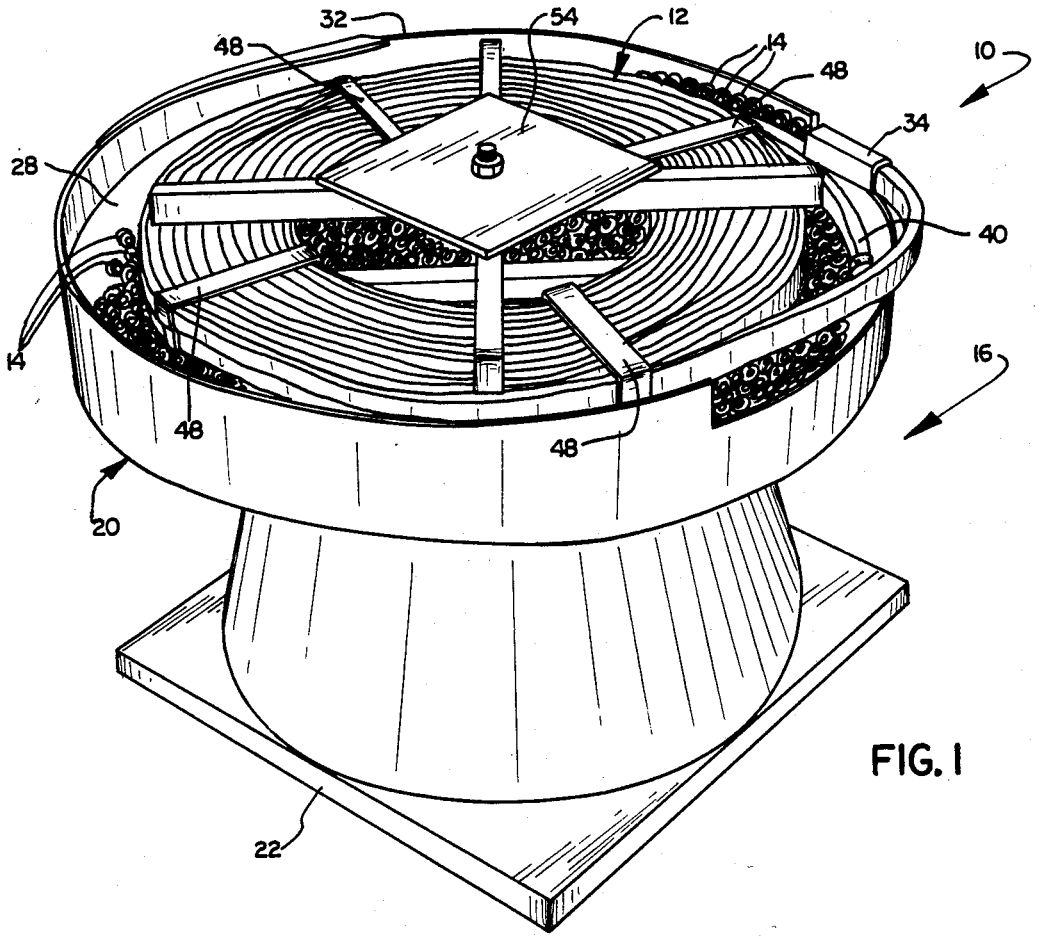
FIG. 1 is a pictorial illustration depicting the manner in which a tube to be filled with articles is mounted on a vibratory feeder.
Figure 2:
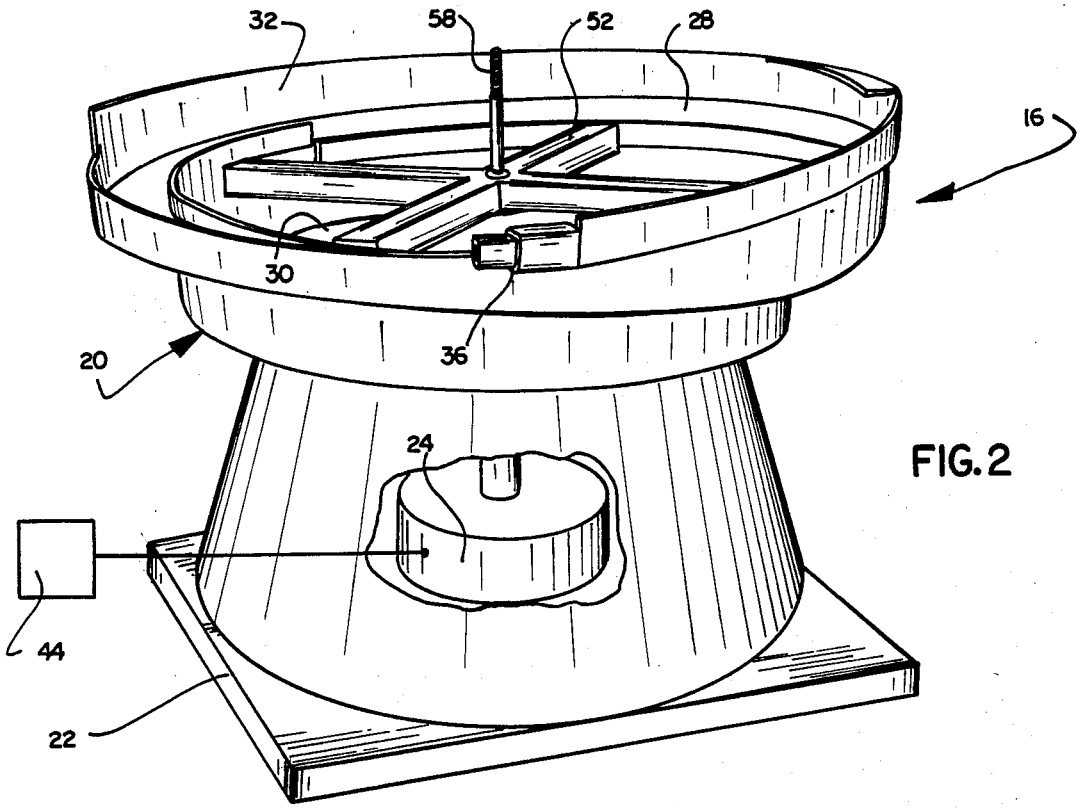
FIG. 2 is a pictorial illustration of the vibratory feeder of FIG. 1 with the tube removed.

An apparatus 10 (FIG. 1) for filling an elongated flexible tube or chute 12 with nuts 14 includes a vibratory feeder 16. The vibratory feeder 16 includes a circular feed bowl 20 which is movable relative to a base 22. Upon operation of a motor 24, illustrated schematically in FIG. 2, the feed bowl 20 is vibrated relative to the base 22 in a known manner.

The feed bowl 20 has a helical track 28 which extends from a bottom or lower portion 30 (FIG. 2) of the feed bowl 20 to a circular open end or rim portion 32 of the feed bowl. An open end 34 of the tube 12 (FIG. 1) is releasably connected with a fitting 36 (FIG. 2) on the feed bowl 20. The fitting 36 is aligned with the upper end of the helical track 28.

Upon operation of the motor 24 and vibratory movement of the feed bowl 20, the nuts 14 move along the track 28, through the fitting 36 and into the tube 12 through the open end 34 of the tube. The opposite end 40 of the tube 12 is blocked so that the nuts 12 cannot leave the tube. Thus, the nuts 14 are fed from the bottom 30 of the bowl 20 into the tube 12 until the tube is completely filled with nuts throughout the length of the tube.

In accordance with a feature of the present invention, the number of nuts 14 being vibrated by the feeder 16 remains constant during filling of the tube 12 with nuts. Therefore, the mass being vibrated by the feeder 16 remains constant. This enables controls 44 (FIG. 2) for the motor 24 to be adjusted to optimize the amplitude and frequency of vibration of the feed bowl 20 during the filling of the tube 12 with nuts 14. If the number of nuts 14 being vibrated was reduced as the tube 12 was filled, the mass being vibrated would be reduced with a resulting change in the amplitude and/or frequency of vibration of the feed bowl 20.

In order to maintain the mass being vibrated constant during feeding of nuts 14 into the tube 12, the tube is supported for vibration with the feed bowl 20. Thus, the nuts 14 in the bowl 20 and the nuts in the tube 12 are vibrated by operation of the motor 24.

The tube 12 is advantageously filled with nuts 14 while the tube is held in a coil by bands 48. The coiled tube 12 is supported on a generally X-shaped bracket 52 (FIG. 2) connected to the feed bowl 20 adjacent to an open upper end of the bowl. The coiled tube 12 is placed on the bracket 52 and clamped in place with a retainer 54. The retainer 54 and bracket 52 cooperate to hold the coiled tube 12 firmly in place in the bowl 20 so that the tube is vibrated with the bowl.

When an empty tube 12 is to be filled with nuts 14, the bowl 20 is partially filled with nuts. These nuts are disposed in the bottom portion 30 of the bowl. The empty tube 12 is rolled into a circular coil and held by the bands 48. Although the tube 12 is flexible, the walls of the tube have sufficient rigidity to prevent collapsing of the coiled tube.

The coiled and banded tube is then placed in the bowl 20 on the bracket 52 above the nuts 14 in the bottom bowl. The open end 34 of the tube 12 is connected with the fitting 36. The opposite or blocked end 40 of the tube 12 is disposed within the bowl 20 so that the entire tube 12 is contained within the bowl. The retainer 54 is then secured to an upstanding post 58 in the center of the bowl 20 and pressed against the coiled tube 12 to clamp the coiled tube between the retainer and the bracket 52.

Actuation of the controls 44 cause the motor 24 to vibrate the feed bowl 20, the nuts 14 and the entire length of the tube 12 with a desired frequency and amplitude. This causes the nuts 14 to be fed along the helical track 28 to the fitting 36 in a known manner. Continued vibration of the bowl 20 causes the nuts to enter the hollow tube 12.

Since the entire tube 12 is being vibrated at the same frequency and amplitude as the bowl 20, the nuts 14 move along the tube from the open end 34 toward the closed end 40 of the tube until the entire tube is filled with nuts. As this is occurring, the nuts 14 remaining in the bowl 20 are vibrated and the nuts which have entered the coiled tube 12 are vibrated. Since the number and the mass of nuts 14 being vibrated remains constant during filling of the tube 12, the motor controls 44 can be set to an optimum frequency and amplitude of vibration which will be maintained throughout the filling of the tube with nuts.

Once the tube 12 has been completely filled, the retainer 54 is disconnected from the post 58 and the filled tube removed from the feed bowl 20. The filled tube 12 can then be used in association with a suitable nut installation tools, such as the apparatus disclosed in U.S. Pat. Nos. 3,098,576 and 4,153,989. Although the tube 12 has been described herein as being filled with nuts 14, it is contemplated that the tube could be filled with different articles if desired.

In view of the foregoing description it is apparent that the present invention provides a new and improved method and apparatus for loading articles 14 into a tube 12. The apparatus includes a feed bowl 20 which holds a plurality of articles 14. The tube 12 is connected with the feed bowl 20 for movement therewith. A motor vibrates the feed bowl 20, tube 12, and articles 14.

Vibration of the articles 14 causes the articles to move from the feed bowl 20 into the tube 12 and to move along the tube. Since the articles 14 in both the feed bowl 20 and the tube 12 are vibrated, the total number of articles and the mass being vibrated remains constant as the articles are fed from the feed bowl into the tube. It is preferred to support the tube 12 in a coil adjacent to the open upper or rim portion 32 of the feed bowl 20.

Having described one specific preferred embodiment of the invention, the following is claimed:

1. An apparatus comprising feed bowl means for holding a plurality of articles, said feed bowl means having a bottom, a generally circular rim portion, and track means for conducting articles upwardly from the bottom of said feed bowl means to the rim portion of said feed bowl means, flexible tube means for holding articles supplied from said feed bowl means, said flexible tube means having an open end portion through which articles from said feed bowl means can enter said flexible tube means and a second end portion which is at least partially closed to block movement of articles out of said tube means, said flexible tube means being disposed in a coil having a plurality of turns which are smaller than said rim portion of said feed bowl means, connector means for connecting the open end portion of said coiled flexible tube means to said rim portion of said feed bowl means for movement therewith, and motor means for vibrating said feed bowl means, coiled flexible tube means and articles in said coiled flexible tube means to move articles from said feed bowl means into said coiled flexible tube means and to move articles along the turns of said coiled flexible tube means while maintaining the total number of articles being vibrated constant.

2. An apparatus as set forth in claim 1 further including bracket means connected with said feed bowl means for supporting said flexible tube means in a coil disposed adjacent to the rim portion of said feed bowl means.

3. An apparatus as set forth in claim 1 wherein said track means includes a feed track having a generally helical configuration with a first end portion adjacent the bottom of said feed bowl means and a second end portion at the rim portion of said feed bowl means to enable articles to move along said feed track from the bottom of said feed bowl means to the rim portion of said feed bowl means, said open end portion of said coiled flexible tube means being connected with the second end portion of said feed track by said connector means to enable articles to move from said feed track into said coiled flexible tube means, said flexible tube means being disposed in a coil having a plurality of turns which are smaller than turns of said feed track.

4. An apparatus as set forth in claim 1 further including bracket means for supporting said flexible tube means in a coil with the second end portion of said flexible tube means disposed within said feed bowl means.

5. An apparatus as set forth in claim 1 further including bracket means connected with said feed bowl means for holding said flexible tube means in a coil and for connecting said coiled flexible tube means with said feed bowl means.

6. An apparatus comprising feed bowl means for holding a plurality of articles, flexible tube means for holding articles supplied from said feed bowl means, said flexible tube means having an open end portion through which articles from said feed bowl means can enter said flexible tube means and a second end portion which is at least partially closed to block movement of articles out of said flexible tube means, connector means for connecting said open end portion of said flexible tube means with said feed bowl means for movement therewith, bracket means for supporting said flexible tube means in a coil having a plurality of turns of different sizes and for connecting the turns of said coiled flexible tube means with said feed bowl means for movement therewith, and motor means for vibrating said feed bowl means, bracket means, coiled flexible tube means and articles in said coiled flexible tube means to move articles from said feed bowl means into said coiled flexible tube means and to move articles along the turns of said coiled flexible tube means while maintaining the total number of articles being vibrated constant.

7. An apparatus as set forth in claim 6 wherein said feed bowl means includes a feed track having a generally helical configuration with a first end portion at a lower portion of said feed bowl means and a second end portion at an upper portion of said feed bowl means to enable articles to move along said feed track from the lower portion of said feed bowl means to the upper portion of said feed bowl means, said open end portion of said coiled flexible tube means connected with the second end portion of said feed track by said connector means to enable articles to move from said feed track into said coiled flexible tube means.

8. An apparatus as set forth in claim 7 wherein a plurality of turns of the coils of said flexible tube means are smaller than turns of said feed track.

9. An apparatus as set forth in claim 7, wherein said bracket means supports said flexible tube means in a coil disposed adjacent to the upper portion of said feed bowl means.

10. An apparatus as set forth in claim 6 wherein said bracket means includes means for supporting said flexible tube means in a coil disposed adjacent an upper portion of said feed bowl means.

11. An apparatus comprising feed bowl means for holding a plurality of articles, said feed bowl means includes a feed track having a generally helical configuration with a first end portion at a lower portion of said feed bowl means and a second end portion at an upper portion of said feed bowl means to enable articles to move along said feed track from the lower portion of said feed bowl means to the upper portion of said feed bowl means, tube means for holding articles supplied from said feed bowl means, said tube means having an open end portion through which articles from said second end portion of said feed track can enter said tube means and a second end portion which is at least partially closed to block movement of articles out of said tube means, bracket means at least partially disposed in said feed bowl means for supporting said tube means in a coil disposed adjacent to the upper portion of said feed bowl means and for connecting said coiled tube means with said feed bowl means for movement therewith, said coiled tube means including a plurality of turns which are of different sizes and which are smaller than turns of said feed track, connector means for connecting the open end portion of said coiled tube means with the second end portion of said feed track, and motor means for vibrating said feed bowl means, bracket means, coiled tube means and articles in said coiled tube means to move articles from said feed bowl means into said tube means and to move articles along the turns of said coiled tube means while maintaining the total number of articles being vibrated constant.

12. An apparatus as set forth in claim 11 wherein said coiled tube means is flexible to enable said coiled tube means to be at least partially uncoiled.

13. A method of loading articles into a flexible tube, said method comprising the steps of providing a vibratory feeder having a bowl and a motor for vibrating the bowl, filling the bowl with a plurality of articles, connecting the flexible tube with the bowl, coiling the flexible tube, sequentially feeding articles from the bowl into the coiled flexible tube by vibrating the bowl, coiled flexible tube and articles, maintaining the mass of the articles being vibrated constant during the feeding of articles from the bowl to the coiled flexible tube, and, thereafter, disconnecting the flexible tube from the bowl with the flexible tube holding articles fed from the bowl.

14. A method as set forth in claim 13 wherein said step of connecting the flexible tube with the bowl is performed after coiling the flexible tube and includes connecting turns of the coiled flexible tube with the bowl.

15. A method as set forth in claim 14 wherein said step of connecting the flexible tube with bowl further includes connecting one end portion of the coiled flexible tube with a rim portion of the bowl, said step of feeding articles includes moving articles through the one end portion of the coiled flexible tube.

16. A method as set forth in claim 13 further including the step of positioning the flexible tube adjacent an upper portion of the bowl, said step of feeding articles including moving articles from the bowl along turns of the coiled flexible tube.

17. A method as set forth in claim 13 wherein said step of coiling the flexible tube is performed prior to performance of said step of connecting the flexible tube with the bowl.

18. A method as set forth in claim 13 wherein said step of connecting the flexible tube with the bowl includes connecting one end of the flexible tube with the bowl, said step of feeding articles including moving articles from the bowl through the one end of the coiled flexible tube and along the turns of the coiled flexible tube toward an end of the coiled flexible tube opposite from the one end, said method further including the step of blocking movement of articles through the end of the coiled flexible tube opposite from the one end to prevent movement of articles out of the coiled flexible tube during feeding of articles into the coiled flexible tube.

19. A method as set forth in claim 13 further including the step of at least partially uncoiling the flexible tube after performing said step of disconnecting the flexible tube from the bowl.

* * * * *